US007665236B2

(12) United States Patent
Jones et al.

(10) Patent No.: US 7,665,236 B2
(45) Date of Patent: Feb. 23, 2010

(54) CLOTHES IRON STORAGE RACK

(76) Inventors: Ruth B. Jones, 707 Cassata Dr., Copiague, NY (US) 11726; Scott A. Jones, 707 Cassata Dr., Copiague, NY (US) 11726; Patricia D. Jones, 100 Washington Ave., Apt. 5-O, Hempstead, NY (US) 11550

( * ) Notice: Subject to any disclaimer, the term of this patent is extended or adjusted under 35 U.S.C. 154(b) by 0 days.

(21) Appl. No.: 12/154,827

(22) Filed: May 27, 2008

(65) Prior Publication Data

US 2008/0289228 A1 Nov. 27, 2008

Related U.S. Application Data

(60) Provisional application No. 60/931,882, filed on May 25, 2007.

(51) Int. Cl.
*D06F 79/02* (2006.01)
*D06F 79/00* (2006.01)

(52) U.S. Cl. ..... 38/96

(58) Field of Classification Search ..... 38/106, 38/107; 219/242; D32/73; 248/117.1–117.7
See application file for complete search history.

(56) References Cited

U.S. PATENT DOCUMENTS

| | | | | | |
|---|---|---|---|---|---|
| 1,523,555 | A | * | 1/1925 | Murphy | 248/117.6 |
| 2,191,649 | A | * | 2/1940 | Gey | 248/117.1 |
| 2,486,448 | A | * | 11/1949 | Traxler | 248/117.1 |
| 2,514,400 | A | * | 7/1950 | Larkins | 248/117.7 |
| 2,528,846 | A | * | 11/1950 | Sitnick et al. | 248/117.4 |
| 2,584,011 | A | * | 1/1952 | Greenberg et al. | 248/117.3 |
| 2,603,438 | A | * | 7/1952 | Adams | 248/117.1 |
| D311,618 | S | * | 10/1990 | Mattesky | D32/73 |
| 5,909,862 | A | * | 6/1999 | Ratliff et al. | 248/117.4 |
| 6,116,550 | A | | 9/2000 | Forbes | |
| 6,226,904 | B1 | | 5/2001 | Brady et al. | |
| 7,004,433 | B2 | | 2/2006 | Clausen et al. | |

* cited by examiner

*Primary Examiner*—Ismael Izaguirre
(74) *Attorney, Agent, or Firm*—James Ray & Assoc.

(57) ABSTRACT

A pressing iron holder for electric clothing irons includes a substantially planar base defining a blunt butt end, a top end, and two side edges, and a flange is fixedly attached substantially perpendicular to the planar base proximal the butt end. Additional features are cord retention protrusions from one of the two side edges for neatly storing the power cord, at least one semi-rigid retaining clip fixedly attached proximal midpoint of each side edge, and a grasping/hanging extension at the top end.

6 Claims, 1 Drawing Sheet

CLOTHES IRON STORAGE RACK

CROSS REFERENCE TO RELATED APPLICATION

This patent application is related to and claims priority from U.S. Provisional Patent Application Ser. No. 60/931,882 filed May 25, 2007.

FIELD OF THE INVENTION

The present invention relates, in general, to storage of heated irons after use, and, more particularly, this invention relates to storage of electric clothes pressing irons and their cords.

BACKGROUND OF THE INVENTION

Prior to the conception and development of the present invention, clothes pressing irons are typically stored after use either upright or horizontally on the horizontal ironing board with the unplugged cord dangling over the edges of the board. This poses a safety hazard besides being unsightly.

A multitude of devices for storing pressing irons have been disclosed in the prior art. A number of these are wall mounted holders with built-in cord supports as shown, for example, in U.S. Pat. Nos. 6,116,550 and 7,004,433. Others focus on insulating the hot iron from surrounding surfaces during cooling after use. Examples of this are provided by U.S. Pat. Nos. 5,909,862 and 6,226,904. A general characteristic of these prior-art devices appears to be a level of complexity and expense that are beyond what the average consumer finds worthwhile for such a simple purpose.

SUMMARY OF THE INVENTION

The present invention provides a pressing iron holder for electric clothing irons that includes a substantially planar base defining a blunt butt end, a top end, and two side edges, and a flange is fixedly attached substantially perpendicular to the planar base proximal the butt end. Additional features are cord retention protrusions from one of the two side edges for neatly storing the power cord, at least one semi-rigid retaining clip fixedly attached proximal midpoint of each side edge, and a grasping/hanging extension at the top end. In an alternative embodiment, the base structure consists of a heavy wire grid with various extensions for gripping and hanging the holder, and for storing the electric cord.

OBJECTS OF THE INVENTION

It is, therefore, one of the primary objects of the present invention to provide a simple, inexpensive holder for pressing irons.

Another object of the present invention is to provide a holder for clothes pressing irons that can be readily transported and hung while the iron is still warm.

Still another object of the present invention is to provide an economical storage device for pressing irons that can also neatly store the power cord.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 2:
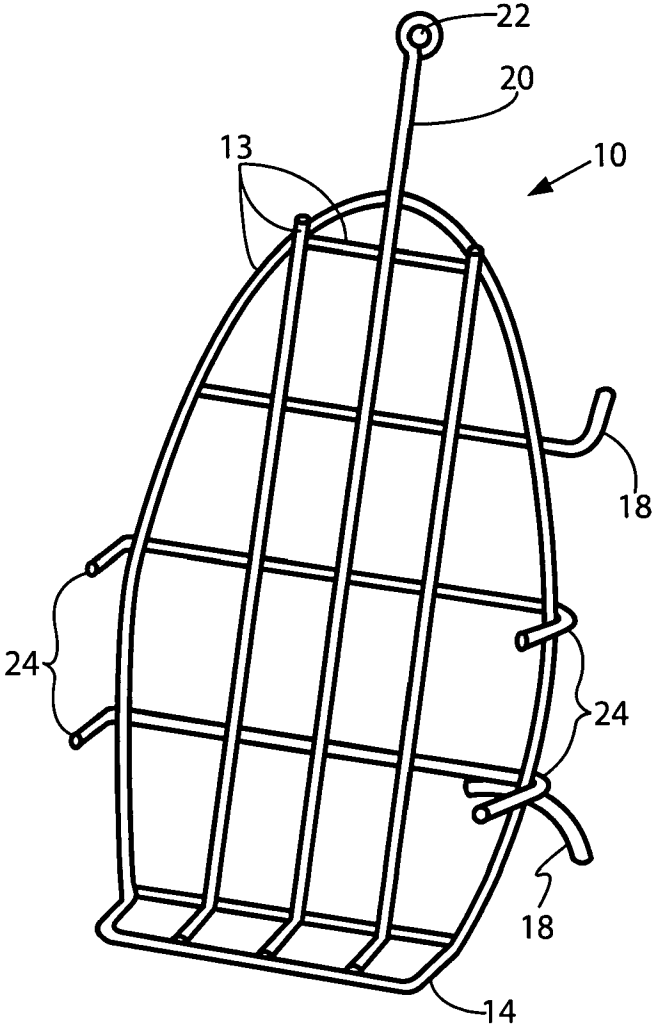
FIG. 2 provides a perspective view of an alternative embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 1:
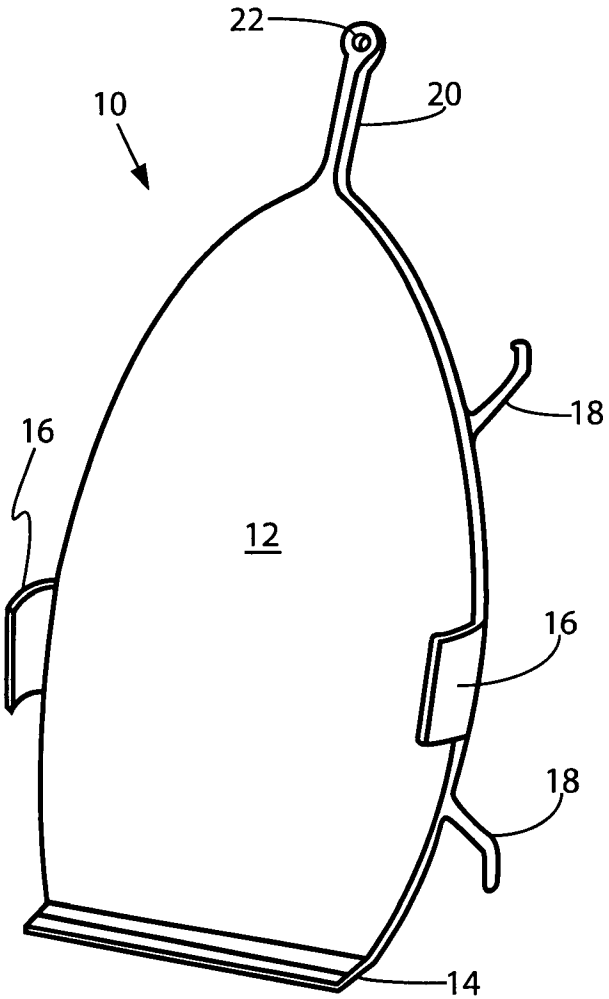
FIG. 1 is a perspective view of an embodiment of the pressing iron holder.

Referring initially to FIG. 1, the present invention is shown, generally as 10, in a perspective view. A solid, planar base plate 12 is shaped and sized similar to that of a common electrical pressing iron. At the widest point, its width should be between about one and twenty millimeters greater than that of the iron it is designed to hold. A flange 14 is attached perpendicularly across the bottom edge of base plate 12. Two clips 16 are opposite one another along and near the center of the edges of the base plate 12 to aid in holding the iron in place. Two cord retaining prongs 18 extend out from one edge of the base in the same plane as the base. Attached to the top end of the base plate 12 is a combination carrying and hanging extension 20, also extending in substantially the same plane. The end of extension 20 includes an aperture 22 that permits hanging the entire unit with iron attached on something like a nail. To use, one holds the iron, even if still warm, by its handle and with the soleplate parallel to the main plane of the base 12, slides the bottom butt end of the iron past the retaining clips 16, which spreads the clips 16 slightly. When the butt end of the iron meets the bottom flange 14, the flange supports the bulk of the weight and the retaining clips 16 restrain side-to-side and movement away from the base 12. The holder 10 and iron together can then be safely grasped and transported using extension 20.

FIG. 2 illustrates a similar alternative embodiment of the present invention, generally shown as 10. A rigid, heavy wire grid 13 forms the main base shaped and sized somewhat like a typical electric clothes iron. At the widest point, the width should be about one to twenty millimeters greater than that of the iron it will be holding. Two of the lateral wire members have bent extensions 24 to help hold the iron in place. These extensions 24 are inclined inward at between about a 75 to 85 degree angles to the plane of the grid. At the butt end of the base structure, the wire members are bent at about 90 degrees to form a bottom flange 14 for bearing most of the weight of the iron when held vertically. Two lateral wire extensions or prongs 18 are spaced along one edge to serve as a place for wrapping the power cord. Use of the device is essentially the same as described in FIG. 1.

While a presently preferred and an alternative embodiment of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A pressing iron holder for electric clothing irons comprising:

a) a substantially planar base having a predetermined width at a widest point and defining a bottom edge, a top end, and two side edges;

b) a flange fixedly attached substantially perpendicular to said planar base proximal said bottom edge;

c) a cord retention means protruding from at least one of said two side edges for neatly storing a power cord;

d) at least one semi-rigid retaining clip fixedly attached proximal to a midpoint of each of said side edges for providing a limited amount of engagement flexibility in the gap between said retaining clips; and e) a hanging means fixedly attached proximal said top end.

2. The pressing iron holder, according to claim 1, wherein said cord retention means is two separated protrusions extending from at least one of said edges of said planar base.

3. The pressing iron holder, according to claim 1, wherein said predetermined width at a widest point is between about one and twenty millimeters greater than that of a typical clothes pressing iron.

4. A pressing iron holder for electric clothing irons comprising:

a) a substantially rigid wire grid base having a predetermined width and defining two side edges, a top end, and a blunt butt end;

b) an integral base flange at said butt end substantially perpendicular to a plane of said wire grid base;

c) at least two bent wire members extending from opposing said side edges of said wire grid base and inclined inwardly at a 75 to 85 degree angle to said wire grid base;

d) a cord retention means protruding from at least one of said two side edges for neatly storing power cord; and e) a hanging means extending from said wire grid base proximal to said top end.

5. The pressing iron holder, according to claim 4, wherein said cord retention means consists of two separated bent wire prongs fixedly attached to at least one of said side edges.

6. The pressing iron holder, according to claim 4, wherein said predetermined width is at the widest point between about one and twenty millimeters greater than that of a typical clothes pressing iron.

* * * * *